US007008267B2

(12) United States Patent
Fan

(10) Patent No.: US 7,008,267 B2
(45) Date of Patent: Mar. 7, 2006

(54) SHIELDED BOARD-MOUNTED ELECTRICAL CONNECTOR

(75) Inventor: Chia Hao Fan, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/977,414

(22) Filed: Oct. 28, 2004

(65) Prior Publication Data

US 2005/0095913 A1 May 5, 2005

(30) Foreign Application Priority Data

Oct. 31, 2003 (TW) ..... 92219417 U

(51) Int. Cl.
*H01R 13/648* (2006.01)

(52) U.S. Cl. ..... 439/607; 439/108

(58) Field of Classification Search ..... 439/607, 439/608, 609, 95, 101, 108, 74
See application file for complete search history.

(56) References Cited

U.S. PATENT DOCUMENTS

| | | | | |
|---|---|---|---|---|
| 5,921,814 | A | 7/1999 | Maruyama | |
| 6,305,982 | B1 * | 10/2001 | Wu | 439/607 |
| 6,623,301 | B1 * | 9/2003 | Lappoehn | 439/607 |
| 6,702,615 | B1 * | 3/2004 | Fan | 439/607 |
| 6,811,439 | B1 * | 11/2004 | Shin-Ting | 439/607 |
| 6,821,149 | B1 * | 11/2004 | Lai | 439/607 |
| 6,932,648 | B1 * | 8/2005 | Chiu et al. | 439/607 |

* cited by examiner

*Primary Examiner*—Hien Vu
(74) *Attorney, Agent, or Firm*—Wei Te Chung

(57) ABSTRACT

An electrical connector (100; 200) mounted on a printed circuit board includes an insulative housing (10; 20), a pair of shells (18, 19; 30, 31) and a number of terminals (15, 16; 26, 27) received in the housing. The housing comprises a mating portion (11; 22) defining a pair of parallel sidewalls extending longitudinally. Each shell (18; 30) comprises a flat portion (181; 301) which provides a plurality of spaced latches (186; 305) bent inwardly from a top thereof for retaining the shell on the housing. The separately formed shells can provide good EMI protection and be manufactured easily and cheaply.

5 Claims, 6 Drawing Sheets

SHIELDED BOARD-MOUNTED ELECTRICAL CONNECTOR

BACKGROUND OF THE INVENTION

1. Field of the Invention

The present invention is related to an electrical connector, and more particularly to a shielded board-mounted electrical connector having an improved shielding shell. The invention relates to the copending applications titled "ELECTRICAL CONNECTOR" and "ELECTRICAL CONNECTOR HAVING IMPROVED ELECTROSTATIC DISCHARGE PROTECTION" having the same application and the same assignee with the instant invention.

2. Description of Related Art

An electrical connector electrically connected to a printed circuit board is often equipped with a metal shield for shielding electrical contacts mounted therein and for avoiding Electro-Magnetic Interference (EMI). U.S. Pat. No. 5,921,814 (named as the '814 patent for simplification) discloses such kind of electrical connector assembly which generally includes a receptacle connector and a plug connector mated with each other.

As shown in FIGS. 1–3 of the '814 patent, the receptacle connector 20 includes an elongated dielectric housing, two rows of terminals received in spaced arrays longitudinally of the dielectric housing and a one-piece conductive shield assembled on the housing. The housing 26 includes a mating portion for mating with a corresponding portion of the plug connector. The mating portion has a pair of long sidewalls 32*a* which extend generally parallel to each other along a longitudinal direction of the housing and a pair of short end walls 32*b* which extend generally parallel to each other along a lateral direction of the housing. The sidewalls and the end walls define an elongated plug-receiving slot 34 therebetween. The metal shield 44 has a plate portion 58 juxtaposed against an inside surface of the long sidewalls and short end walls of the dielectric housing.

As shown in FIGS. 6–7, and 10 of the '814 patent, the plug connector 22 includes an elongated dielectric housing, two rows of terminals received in spaced arrays longitudinally of the dielectric housing and a one-piece conductive shield assembled on the housing. The housing includes opposite end portions extending longitudinally outwardly from a central mating portion thereof. The mating portion of the plug connector comprises a pair of parallel long sidewalls 78*a* extending longitudinally and a pair of parallel short end walls 78*b* extending laterally to define a generally hollow, elongated opening. The metal shield 90 has an elongated plate portion 92 substantially surrounding the mating portion of the housing of the plug connector. When the plug connector is mated with the receptacle connector, the plate portions of the shields of the receptacle connector and the plug connector together define a closed loop, which encloses the terminals inside, to provide EMI protection.

However, each of the shields of the plug connector and of the receptacle connector is formed by drawing technology during the process of being stamped and molded. Using drawing technology, a designer must make more effort to design a die which is costly and the manufacture of the shield is still difficult.

Hence, an improved shielded board-mounted electrical connector is required to overcome the above-mentioned disadvantages of the related art.

SUMMARY OF THE INVENTION

A major object of the present invention is to provide an improved board-mounted electrical connector having a shielding shell which is cost efficient and easily manufactured.

In order to achieve the object set forth, an electrical connector in accordance with the present invention comprises an elongated housing having a mating portion and a plurality of terminal channels, a plurality of conductive terminals received corresponding terminal channels and a pair of shielding shells. The mating portion defines a receiving space surrounding by two longitudinally extended sidewalls and communicating with the terminal channels. Each sidewall defines a plurality of spaced notches in a top thereof and a plurality of recesses in a bottom thereof. Each shell comprises a flat portion for covering on an outside surface of the sidewalls of the mating portion. The flat portion has a plurality of spaced latches in a top thereof received in the notches and a plurality of grounding tails in a lower portion thereof extending through the recesses.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
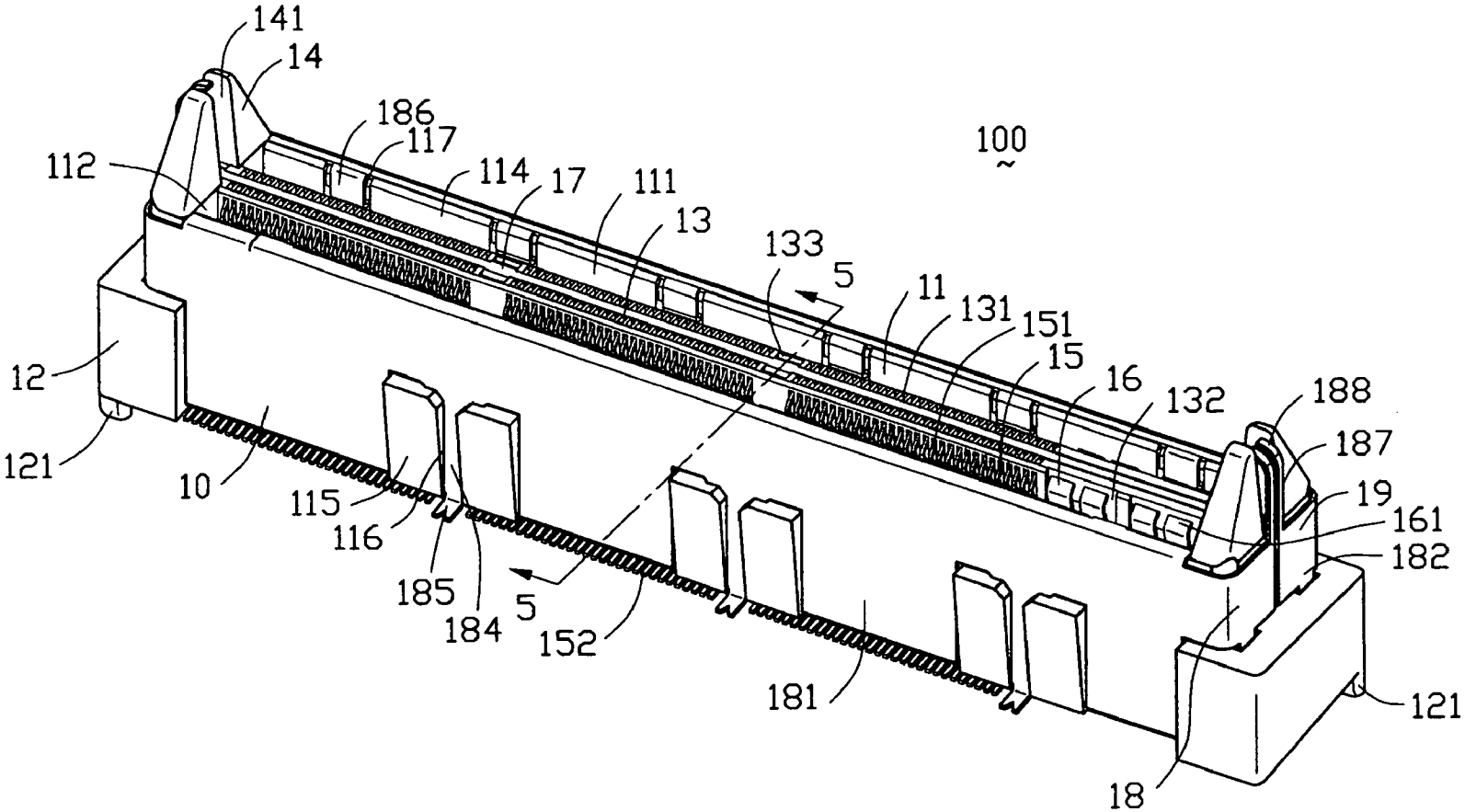
FIG. 1 is a perspective view of a receptacle connector of a connector assembly in accordance with the present invention.
Figure 3:
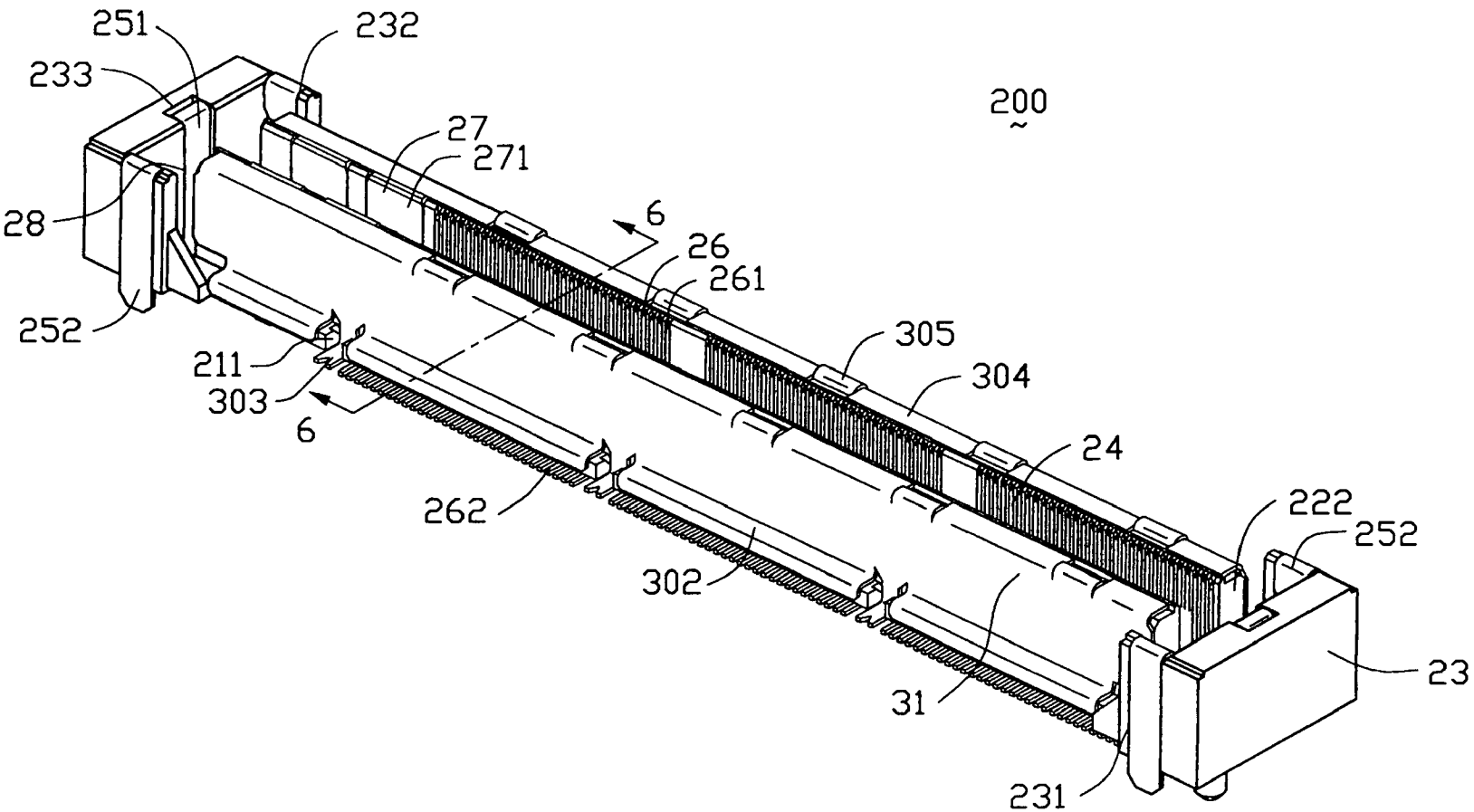
FIG. 3 is a perspective view of a plug connector of the connector assembly in accordance with the present invention.

Please refer to FIGS. 1 and 3, the feature of the present invention are shown in a connector assembly which includes a receptacle connector 100 and a plug connector 200.

Figure 2:
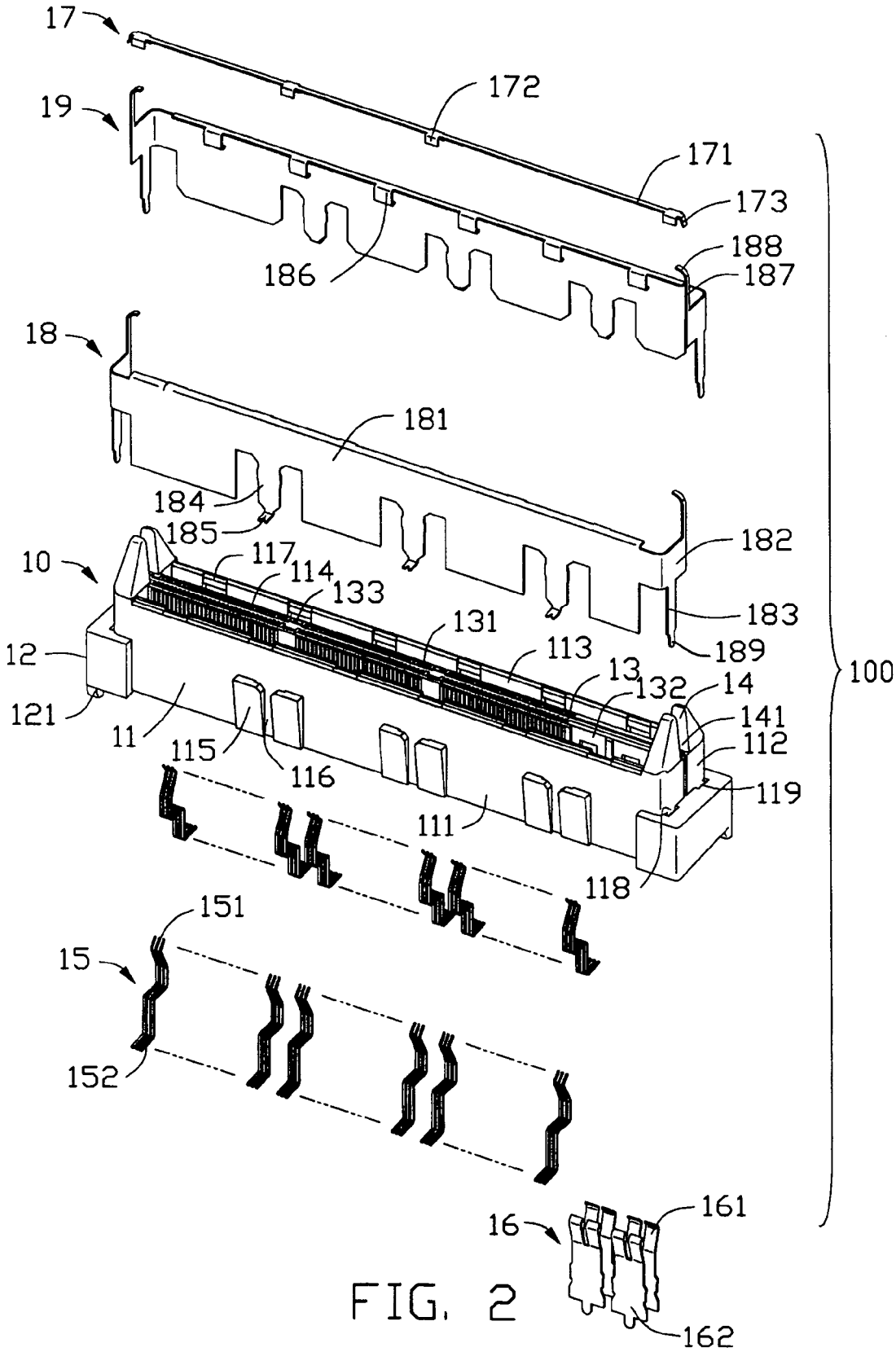
FIG. 2 is an exploded, perspective view of the receptacle connector of FIG. 1.

With reference to FIGS. 1 and 2, the receptacle connector 100 for mounting onto a surface of a printed circuit board (not shown) comprises an insulative housing 12, a plurality of conductive terminals 15, 16 received in the insulative housing 12 and a pair of first and second shielding shell 18, 19 assembled on the insulative housing 12.

The insulative housing 10 is elongated and comprises a rectangular mating portion 11 and end portions 12 disposed in two opposite ends of the mating portion 11. The mating portion 11 includes a pair of long sidewalls 111 extending along a longitudinal direction of the insulative housing 10, a pair of short end walls 112 extending generally along a lateral direction of the insulative housing 10 and a tongue plate 13 extending upwardly from a bottom wall of the mating portion 11. The sidewalls and the end walls together define a generally rectangular receptacle 114 therebetween and the tongue plate 13 is located in a center of the receptacle 114. A plurality of terminal channels 131, 132 and mating holes 133 are formed on two opposite surfaces of the tongue plate 13. A plurality of spaced notches 117 are formed on an inside surface of the sidewalls 111. Each end wall 112 forms a pair of taper-shaped guiding posts 14 extending upwardly from an upper end thereof and having a cutout 141 defined therebetween. Plural pairs of protrusions 115 are formed on an outside surface of the sidewalls 111 and each pair of protrusions form a recess 116 therebetween. The end portions 12 extend outwardly from the end walls 112 of the mating portion 11 and a pair of splits 182 are defined between the end portion 12 and the end wall 112. The end portions 12 form locating legs 121 in a bottom thereof and extending downwardly.

The plurality of conductive terminals include a plurality of signal and power terminals 15, 16 respectively received in corresponding terminal channels 131, 132. Each terminal 15, 16 includes a contact portion 151, 161 for engaging with a contact of the plug connector 200 and a tail portion 152, 162 extending downwardly from the contact portion 151, 161 beyond the mating portion 11 for mounting to the printed circuit board.

A metallic beam 17 is pole-shaped and includes an elongated base 171, a plurality of tabs 172 extending from two opposite longitudinal sides of the base 171 for engaging with the mating holes 133 of the tongue plate 13 and grounding tabs 173 located at two opposite ends of the base 171.

The first and the second shielding shells 18, 19 are assembled onto the mating portion 11 of the insulative housing 10 and have the same structure as each other. Each of shielding shells 18, 19 is stamped from a metal sheet and has a flat portion 181 for covering on the outside surface of the sidewalls 111 of the mating portion 11, and a pair of opposite wings 182 extending laterally from opposite ends of the body 181 for covering outer sides of the end walls 112 of the mating portion 11 and electrically connecting with the grounding tabs 173 of the metallic beam 17. The flat portion 181 disposes a plurality of grounding legs 184. The grounding legs 184 are received in corresponding recesses 116 of the insulative housing 10 and then bent to form a grounding tail 185 for connecting the first and the second shielding shell 18, 19 to appropriate ground circuit traces on the printed circuit board. A plurality of spaced latches 186 extend inwardly and downwardly from a top of the flat body 181 for mating with the notches 117 of the insulative housing 10. Each wing 182 forms a retention leg 183 extending downwardly from a bottom thereof with a retention tip 189 extending somewhat oblique to the retention leg 183 and received in a corresponding split 118, 119 of the end portion 12. The oblique retention tip 189 can extend through a corresponding retention through hole in the oblique printed circuit board, on which the housing 10 is directly seated, in a perpendicular manner. The wing 182 further has a engaging finger 187 extending upwardly form a top thereof for being received in the cutout 141 of the insulative housing 10 and having a latching tail 188.

In assembly, the terminals 15, 16 are inserted into corresponding terminal channels 131, 132 of the insulative housing 10 in a down-to-up direction. The first and the second shielding shells 18, 19 are assembled onto the insulative housing 10 in an up-to-down direction. The grounding legs 184 and the latches 186 of the shielding shells 18, 19 respectively engage with the recesses 116 and the notches 117 of the insulative housing 10 so that the shielding shell 18, 19 are firmly attached onto the insulative housing 10. The wings 182 of the shielding shells 18, 19 join to each other to form a closed loop enclosing the sidewalls 111 and the end walls 112 of the mating portion 11 therein. Therefore, the shielding shells 18, 19 can provide good anti-EMI protection to the contact portions 151, 161 of the terminals 15, 16 located therebetween.

Figure 4:
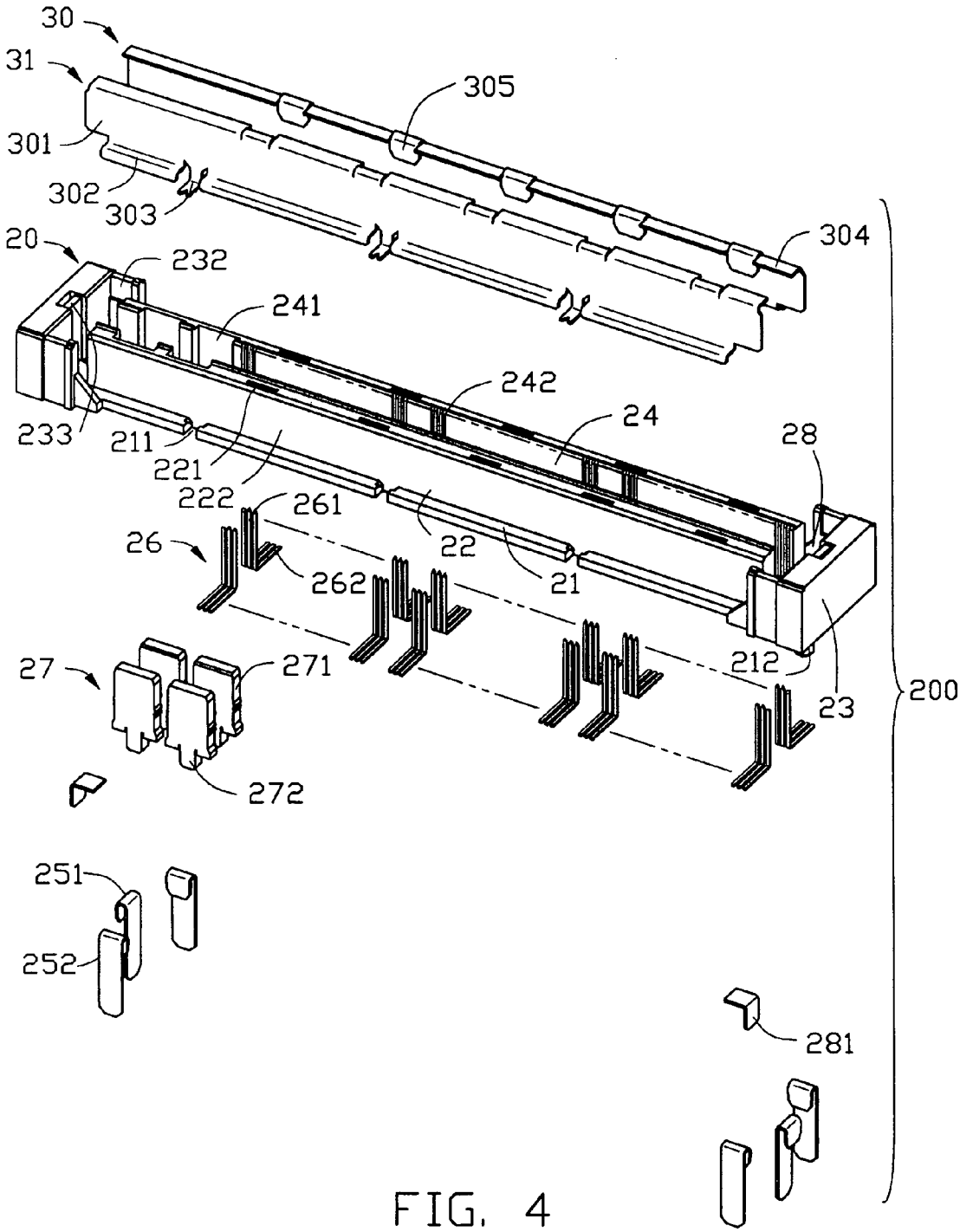
FIG. 4 is an exploded, perspective view of the plug connector of FIG. 3.
Figure 5:
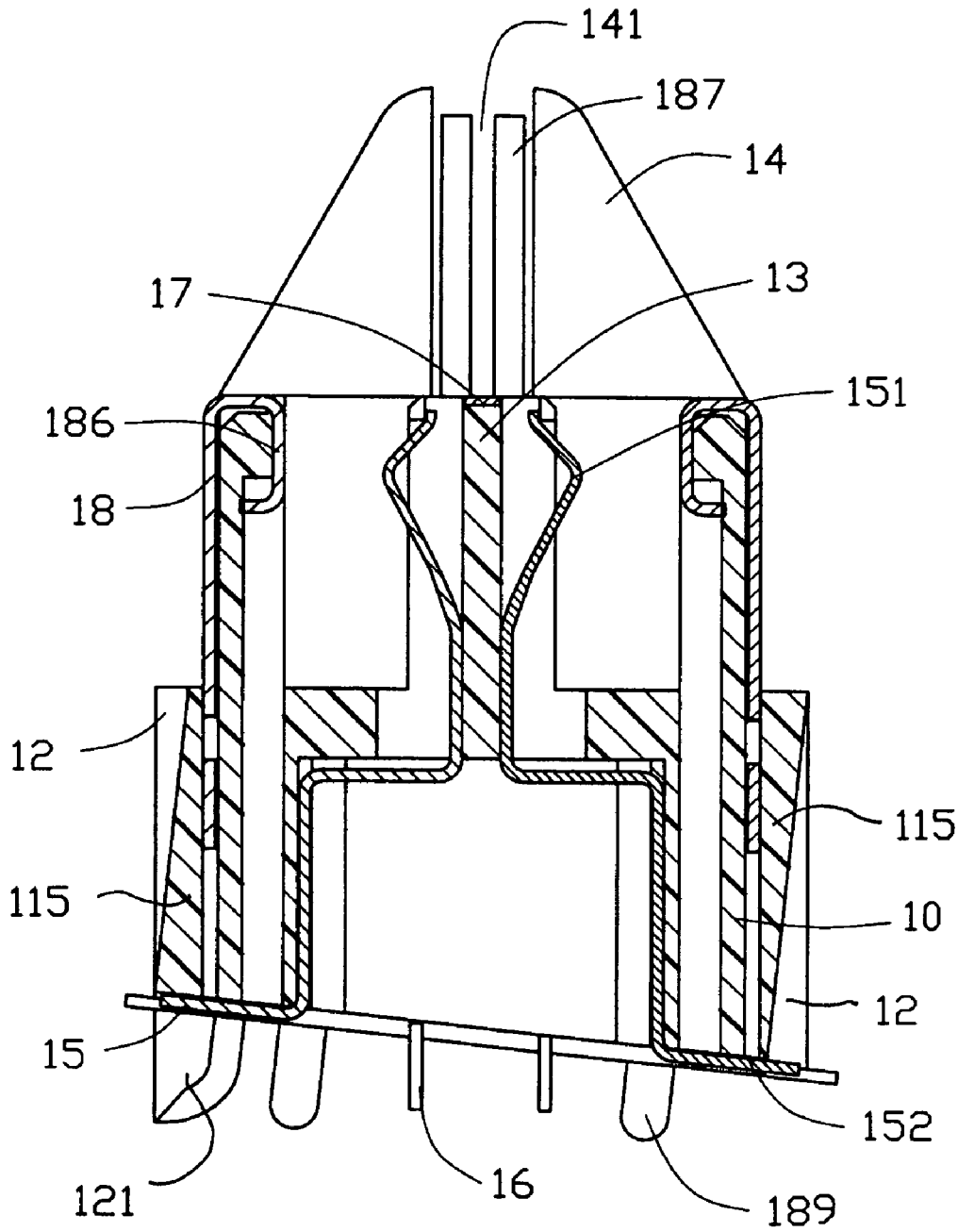
FIG. 5 is a cross-sectional view of the receptacle connector taken along line 5—5 of FIG. 1.
Figure 6:
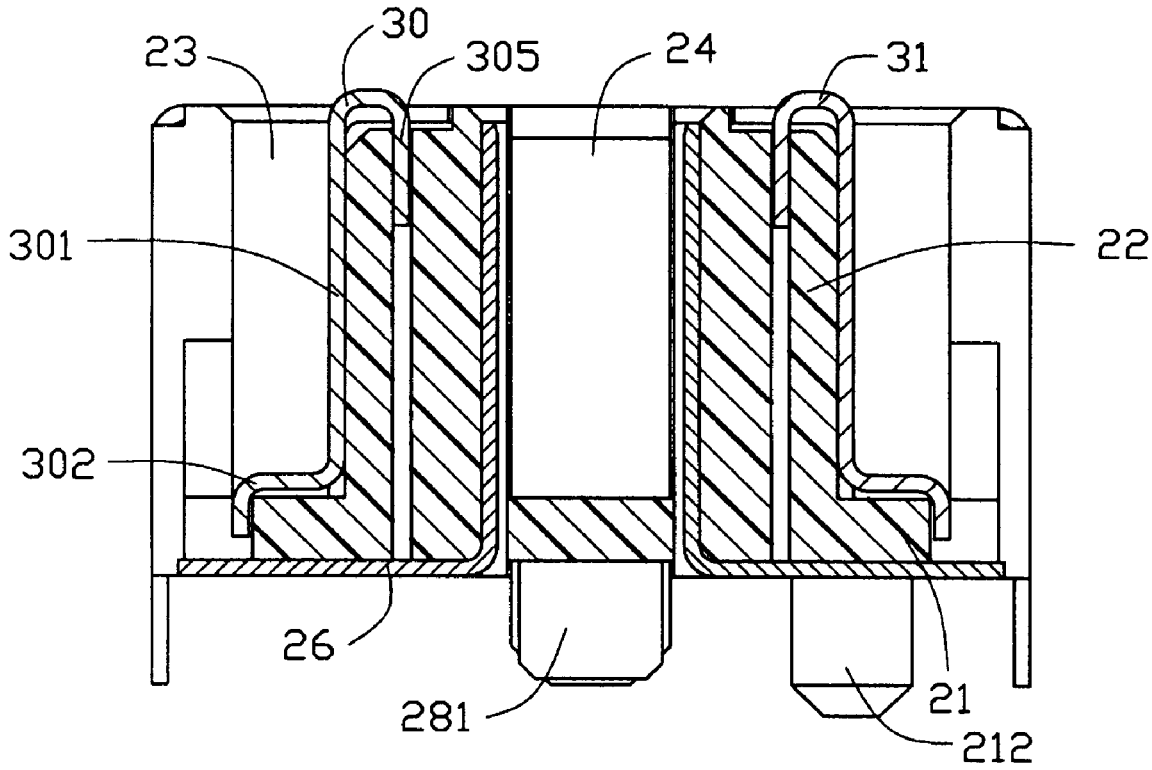
FIG. 6 is a cross-sectional view of the plug connector taken along line 6—6 of FIG. 3.

With reference to FIGS. 3 and 4, the plug connector 200 comprises an insulative housing 20, a plurality of conductive terminals 26, 27 received in the insulative housing 20, and first and second shielding shells 30, 31 assembled to the insulative housing 20.

The insulative housing 20 is elongated and includes a mating portion 22. The mating portion 22 comprises a pair of long sidewalls 222 which extend generally parallel to each other along a longitudinal direction of the insulative housing 20 and a pair of short end walls 23 which extend generally parallel to each other along a lateral direction of the insulative housing 20. The sidewall 222 and the end walls 23 together define an elongated slot 24 therebetween. The sidewall 222 forms a plurality of supporting ribs 21 in a bottom thereof and extending outwardly, and recesses between two supporting ribs 21, and defines a plurality of notches 221 in a top thereof and extending downwardly. A plurality of terminal channels 241, 242 are defined on an inside surface of the sidewalls 222. The end walls 23 define a plurality of grooves 232, 233 respectively receiving metal plates 251, 252. The end walls 23 don't connect with the sidewalls 222 and form a receiving room therebetween receiving grounding plate 281 extending downwardly beyond a bottom of the mating portion 22 for connecting with the printed circuit board. The end walls 23 form locating legs 212 extending downwardly for engaging with the printed circuit board.

The plurality of conductive terminals includes a plurality of signal and power terminals 26, 27 respectively received in corresponding terminal channels 242, 241. Each terminal 26, 27 includes a contact portion 261, 271 for engaging with a contact of the receptacle connector 100 and a tail portion 262, 272 extending downwardly from the contact portion 261, 271 beyond the supporting ribs 21 for mounting to the printed circuit board.

The first and the second shielding shells 30, 31 are assembled onto the mating portion 22 of the insulative housing 10 and have the same structure as each other. Each of shielding shells 30, 31 has a flat portion 301 for covering on the outside surface of the sidewalls 222 of the mating portion 22, a plurality of bent portions 302 bent extending from a bottom of the flat portion 301 and grounding tails 303 extending vertically through the recesses 211 of insulative housing 20 for electrically connecting to appropriate ground circuit traces on the printed circuit board. The flat portion 301 provides a plurality of bent tabs 304 in a top thereof for covering a top end of the sidewalls 222 of the mating portion 22 and latches 305 for engaging with the notches 221 of the sidewalls 222.

In assembly, the terminals 26, 27 are inserted into corresponding terminal channels 241, 242 of the insulative housing 10 in a down-to-up direction. The first and the second shielding shells 30, 31 are assembled onto the insulative housing 20 in an up-to-down direction. The grounding tails 303 and the latches 305 of the shielding shells 30, 31 respectively engage with the recesses 211 and the notches 221 of the insulative housing 20 so that the shielding shells 30, 31 are firmly attached onto the insulative housing 20. The mating portion 33 is entirely surrounded by the first and the second shielding shells 30, 31. Therefore, the shielding shells 30, 31 can provide good EMI protection to the contact portions 261, 271 of the terminals 26, 27 located between.

When the receptacle connector 100 mates with the plug connector 200, the mating portion 22 of the plug connector 200 is received in the receptacle 114 of the receptacle connector 100, and the tongue plate 13 of the receptacle connector 100 is received in the slot 24 of the plug connector 200. The contact portions 261, 271 of the terminals 26, 27 of the plug connector 200 respectively engage with the contact portions 151, 161 of the terminals 15, 16 of the receptacle connector 100. The guiding posts 14 of the receptacle connector 100 are respectively received in the receiving rooms 28 of the plug connector 20. During mating process, the engaging fingers 187 of the shielding shells 18, 19 of the receptacle connector 100 first abut against the metal plates 251 of the plug connector 200 to discharge Electro-Static charge accumulated in the connector, then the latches 186 of the shielding shells 18, 19 of the receptacle connector 100 engage with the flat portion 301 of the shielding shells 30, 31 of the plug connector 200 to form an electrical connection between the shielding shells 18, 19 of the receptacle connector 100 and the shielding shells 30, 31 of the plug connector 200. The wings 182 of the shielding shell 18, 19 electrically connect with the metal plates 251, 252 disposed in the grooves 233, 232 of the plug connector 200 to achieve good shielding effect.

It is noted that the protrusions 115 on the outside surface of two side wall 111 are configured to be wedged for consideration of not only easy inspection of the soldering between the tail portions 152 and the printed circuit board thereunder while still maintaining the required strength thereof, but also resulting in a visional effect of a perpendicular relation between the protrusions 115 and the printed circuit board rather than an oblique manner performed by the remainder of the housing 10 with regard to the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a mating portion, the mating portion defining a receiving space surrounded by two longitudinally extended sidewalls, two end walls and a plurality of terminal channels communicating with the receiving space, each sidewall defining a plurality of notches;

a plurality of conductive terminals received in corresponding terminal channels and each having a contact portion; and a pair of shielding shells having substantially symmetrical structure and respectively attached to the housing, each shielding shell having a flat portion enclosing said sidewall, and the flat portion providing a plurality of latches extending therefrom received in said notches and a plurality of grounding tails extended in a bottom thereof and being substantially perpendicular to the flat portion;

wherein said insulative housing has a tongue plate extending upwardly from a bottom of the mating potion, and said terminal channels are defined in two opposite sides of the tongue plate;

wherein each shielding shell further comprises a pair of wings located at two opposite ends of the flat portion;

wherein the connector further comprises a metallic beam and the metallic beam comprising an elongated base, a plurality of tabs extending from the base, and a plurality of grounding tabs for electrically connecting with the wings of the shielding shell;

wherein said tongue plate defines a plurality of mating holes in a top thereof for receiving tabs of the metallic beam; and wherein each sidewall forms plural pairs of protrusions and each pair of protrusions defines a recess therebetween for receiving said grounding tails.

2. The electrical connector as claimed in claim 1, wherein each end wall provides a pair of guiding posts having a cutout defined therebetween.

3. The electrical connector as claimed in claim 2, wherein each wing of the shielding shell has an engaging finger extending upwardly for being received in said cutout.

4. The electrical connector as claimed in claim 3, wherein each end portion defines a split in an inside thereof and each wing of the shielding shell has a retention leg received in said split.

5. An electrical connector comprising:

an elongated insulative housing extending in a lengthwise direction and comprising a mating face and mounting face opposite to said mating face in an oblique relation therewith, a mating portion located behind the mating face and defining a receiving space therein;

a plurality of conductive terminals disposed in the housing, each of said terminals having a contact portion extending into the receiving space, and a tail portion for surface mounting to a printed circuit board;

at least one shielding shell attached to the housing, the shielding shell having a flat portion enclosing an exterior side of a corresponding sidewall; and having grounding tails extended at a bottom portion thereof and a retention tip on an edge portion of the shielding shell;

at least one protrusion formed on the exterior to retain the shielding shell in position; wherein said protrusion defines a wedged configuration in a vertical cross-sectional view in a transverse direction perpendicular to said lengthwise direction;

wherein there two shielding shells attached to two exterior sides of two corresponding side walls, respectively, and there are two protrusions formed on said two exterior sides, of which both define two wedged configurations directing to opposite directions with each other; and wherein each said shielding shells includes a retention leg, of which said retention tip is located at a distal end, and said retention leg extends through a slit in an end of the housing, and wherein the retention leg is normal to the mating face while oblique to the retention tip.

* * * * *